US012442593B2

(12) United States Patent
Lochner et al.

(10) Patent No.: US 12,442,593 B2
(45) Date of Patent: Oct. 14, 2025

(54) METHOD FOR OPERATING AN AIR SEPARATION PLANT, HAVING A DISTILLATION COLUMN SYSTEM, A HEAT EXCHANGER AND AN ADSORBER, AND AIR SEPARATION PLANT

(71) Applicant: Linde GmbH, Pullach (DE)

(72) Inventors: Stefan Lochner, Grafing (DE); Ralph Spöri, Egling (DE); Christoph Windmeier, Geretsried (DE); Pascal Freko, Eurasburg (DE); Andreas Obermeier, Egling (DE)

(73) Assignee: Linde GmbH, Pullach (DE)

( * ) Notice: Subject to any disclaimer, the term of this patent is extended or adjusted under 35 U.S.C. 154(b) by 695 days.

(21) Appl. No.: 17/756,747

(22) PCT Filed: Nov. 19, 2020

(86) PCT No.: PCT/EP2020/025521

§ 371 (c)(1),
(2) Date: Jun. 1, 2022

(87) PCT Pub. No.: WO2021/110285

PCT Pub. Date: Jun. 10, 2021

(65) Prior Publication Data

US 2023/0003446 A1 Jan. 5, 2023

(30) Foreign Application Priority Data

Dec. 6, 2019 (EP) ..... 19020677

(51) Int. Cl.
*F25J 3/00* (2006.01)
*F25J 3/04* (2006.01)

(52) U.S. Cl.
CPC ..... *F25J 3/04787* (2013.01); *F25J 3/0409* (2013.01); *F25J 3/04812* (2013.01);
(Continued)

(58) Field of Classification Search
CPC .. F25J 3/04812; F25J 3/04818; F25J 3/04824; F25J 3/04836; F25J 3/0409; F25J 2240/10; F25J 2280/02; F25J 2280/30
See application file for complete search history.

(56) References Cited

U.S. PATENT DOCUMENTS 5,778,700 A 7/1998 Lee et al.
2020/0080773 A1* 3/2020 Xu ..... F25J 3/0409

FOREIGN PATENT DOCUMENTS

FR 1322843 A 4/1963
GB 1216192 A 12/1970
(Continued)

*Primary Examiner* — Brian M King
(74) *Attorney, Agent, or Firm* — Millen, White, Zelano & Branigan; Brion P. Heaney

(57) ABSTRACT

A method for operating an air separation plant having a distillation column system, a heat exchanger, and an adsorber, wherein, in a first time period, a first operating mode is carried out and, in a second time period following the first time period, a second operating mode is carried out. In a third time period between the second time period and the first time period, a third operating mode is carried out, in which third operating mode compressed air is at least partially freed of water and carbon dioxide in the adsorber and at least part of said compressed air is cooled in the heat exchanger, an air product is removed from the distillation column system and at least part of said air product is heated in the heat exchanger.

14 Claims, 7 Drawing Sheets

(52) U.S. Cl.
CPC ..... *F25J 3/04824* (2013.01); *F25J 2240/10* (2013.01); *F25J 2280/02* (2013.01)

(56) References Cited

FOREIGN PATENT DOCUMENTS

| | | | |
|---|---|---|---|
| GB | 1331458 | A | 9/1973 |
| GB | 2126700 | A | 3/1984 |
| JP | H02275281 | A | 11/1990 |

* cited by examiner

METHOD FOR OPERATING AN AIR SEPARATION PLANT, HAVING A DISTILLATION COLUMN SYSTEM, A HEAT EXCHANGER AND AN ADSORBER, AND AIR SEPARATION PLANT

The invention relates to a method for operating an air separation plant which comprises a distillation column system designed for cryogenic rectification, a heat exchanger, and an adsorber, and to a corresponding air separation plant according to the preambles of the respective independent claims.

PRIOR ART

The production of air products in the liquid or gaseous state by cryogenic fractionation of air in air separation plants is known and described, for example, in H.-W. Häring (editor), Industrial Gases Processing, Wiley-VCH, 2006, in particular Section 2.2.5, "Cryogenic Rectification." Further details of corresponding methods and plants in the specific context of the present invention are explained further below.

In a large number of fields of application, including for the production of air products in air separation plants, heat exchangers (technically more correct: heat transfer devices) are operated with cryogenic fluids, i.e., fluids at temperatures significantly below 0° C., in particular significantly below −100° C. The present invention is described below predominantly with reference to the main heat exchangers of air separation plants to which air which has already been dried in an adsorber and freed of carbon dioxide is supplied for cooling. However, the invention does not relate to plants which have heat exchangers which are used to freeze water and carbon dioxide out of air, and which are therefore operated cyclically in order to remove frozen water and carbon dioxide from the heat exchanger from time to time. Such plants require operating modes adapted specifically to the purpose of cleaning, which cannot be transferred to heat exchangers as used within the scope of the present invention.

For the construction and operation of main heat exchangers of air separation plants, reference is made to Häring (see above), section 2.2.5.6, "Apparatus". Details on heat exchangers in general can be found, for example, in the publication "The Standards of the Brazed Aluminium Plate-Fin Heat Exchanger Manufacturers' Association," 2nd edition, 2000, in particular section 1.2.1, "Components of an Exchanger." Where reference is made in the description below to a "heat exchanger", this always means the main heat exchanger of an air separation plant.

Without additional measures, heat exchangers of air separation plants perform temperature equalization and heat up when the associated plant is at a standstill and the heat exchanger is thus taken out of operation, or the temperature profile forming in a corresponding heat exchanger during steady-state operation cannot be maintained in such a case.

In particular, when a heat exchanger is taken out of operation before it has completely heated up, the temperatures at the previously warm end and at the previously cold end equalize due to the good thermal conduction (thermal longitudinal conduction) in its metallic material. In other words, the previously warm end of the heat exchanger becomes colder over time, and the previously cold end of the heat exchanger becomes warmer, until said temperatures are at or close to an average temperature. This is also illustrated again in the attached FIG. 1. The temperatures, which were here at approximately −175° C. and +20° C., respectively, at the time of taking out of operation, converge over several hours and almost reach the average temperature.

This behavior is observed in particular when the main heat exchanger, which is accommodated in a cold-insulated manner, is blocked in together with the rectification unit, i.e., when no more gas is supplied from the outside, when an air separation plant is switched off. In such a case, typically, only gas produced by thermal insulation losses is blown off cold.

If warm air is subsequently fed in at the cooled warm end of the heat exchanger when it is put back into operation, the temperature rises abruptly there. The temperature at the heated cold end correspondingly decreases abruptly if a cold air product from the distillation column system of the air separation plant is fed in there when the heat exchanger is put back into operation. This leads to the aforementioned material stresses and thus, possibly, to damage in the long term.

The object of the present invention is therefore in particular to specify measures which allow a heat exchanger of an air separation plant to be put back into operation even after being out of operation for a relatively long time, without the aforementioned disadvantageous effects occurring.

DISCLOSURE OF THE INVENTION

Against this background, the present invention proposes a method for operating an air separation plant having a distillation column system designed for cryogenic rectification, a heat exchanger and an adsorber, and to a corresponding air separation plant having the features of the respective independent claims.

First, some terms used to describe the present invention are explained and defined below.

In the terminology used herein, a "heat exchanger" is an apparatus which is designed for indirectly transferring heat between at least two fluid flows, for example guided in counter-flow relative to one another. A heat exchanger for use within the scope of the present invention can be formed from one or more heat exchanger sections connected in parallel and/or in series, e.g., from one or more plate heat exchanger blocks. A heat exchanger has "passages" which are configured to conduct fluid and are separated fluidically from other passages by separating plates or connected on the inlet and outlet sides only via the respective headers. The passages are separated from the outside by means of side bars. Said passages are referred to below as "heat exchanger passages." The terms "heat exchanger" and "heat transfer device" are used synonymously below. The same also applies to the terms "heat exchange" and "heat transfer." The "main heat exchanger" of an air separation plant is characterized in that at least the majority of the air to be separated and the air products formed are guided through it.

The present invention relates in particular to the apparatuses referred to as plate-fin heat exchangers according to ISO 15547-2:2005. Therefore, if a "heat exchanger" is referred to below, this is to be understood as meaning in particular a plate-fin heat exchanger. A plate-fin heat exchanger has a plurality of flat chambers or elongate channels lying one above the other, which are separated from one another in each case by corrugated or otherwise structured and interconnected, for example soldered, plates, generally made of aluminum. The plates are stabilized by means of the side bars and connected to one another via said side bars. The design of the heat exchanger plates serves in particular to increase the heat exchange surface but also to increase the stability of the heat exchanger. The invention relates in particular to soldered plate-fin heat exchangers made of aluminum. In principle, however, corresponding heat exchangers can also be produced from other materials, for example stainless steel, or from various different materials.

Air separation plants have distillation column systems which can conventionally be designed, for example, as two-column systems, in particular as classical Linde double-column systems, but also as three-column or multi-column systems. In addition to the distillation columns for extracting nitrogen and/or oxygen in the liquid and/or gaseous state, i.e., distillation columns for nitrogen-oxygen separation, distillation columns for extracting further air components, in particular the noble gases krypton, xenon, and/or argon, can be provided. Usually, terms such as "rectification" and "distillation" as well as "column [Saule]" and "column [Kolonne]" or terms composed therefrom are used synonymously. The present invention is suitable for air separation plants having any distillation column systems which are operated at cryogenic temperatures, i.e. at least partially less than −100° C. Reference is made to the relevant technical literature for details.

The air supplied to an air separation plant is initially compressed in the so-called main air compressor to a pressure level which depends on the specific mode of operation of the air separation plant and can typically be at the highest operating pressure in the distillation column system or significantly above it. The air heats up during this compression and is therefore then initially cooled in a direct contact cooler. This cooling reduces the moisture content of the water-saturated air and thus reduces the effort for subsequent drying.

In addition to water, the air now contains, in particular, carbon dioxide. Water and carbon dioxide must be removed since, during the subsequent cooling in the main heat exchanger, solids can form as a result of desublimation or freezing, which gradually clog or impede the heat exchanger. Hydrocarbons present in the air can likewise be problematic, since they are less volatile than nitrogen and oxygen and can therefore accumulate in the liquid oxygen which is formed, for example, in the bottom of the low-pressure column. To remove the components mentioned, adsorbers are used at least in more recent types of air separation plants.

An adsorber of an air separation plant, as described in Häring (see above) in section 2.2.5.6, "Apparatus", typically has adsorption containers arranged in pairs, which are switched between adsorption mode and regeneration mode. The adsorption material used is typically zeolites which act as a molecular sieve. An adsorption cycle typically takes between 1.5 h and 6 h and is carried out at the pressure level of the compressed air. Prior to regeneration, the pressure is typically relieved to ambient pressure within approximately 10 min. Regeneration is carried out using a dry regenerating gas flow in counter-current flow direction. Regeneration is divided into a heating phase in which the regenerating gas flow is heated and a subsequent cooling phase with cold regenerating gas. A pressure build-up phase of approximately 20 minutes follows.

By means of an adsorber, gaseous and substantially water-free and carbon dioxide-free compressed air is thus provided, which can be cooled in the main heat exchanger. As mentioned, however, the present invention does not relate to plants in which, like for example in U.S. Pat. No. 3,469,271 A, corresponding components are removed by freezing out of the compressed air used.

Where an "air product" is mentioned here, this is understood to mean a gas or a liquid or a medium in the supercritical state which has one or more components contained in atmospheric air but no further components (which are not part of air). The one or more components from atmospheric air can be present in the air product in the same or in other absolute or relative proportions than in atmospheric air.

An air product or other fluid is "free" of water and carbon dioxide in the sense to be understood here when it has no detectable fractions of water and carbon dioxide. It can also be "substantially" free of water and carbon dioxide in the usual sense, so that water and carbon dioxide are not present in effective amounts. In particular, residual contents of up to a few ppm (parts per million) of water and carbon dioxide can be present, without the essential properties of the feed air or of a corresponding air product in relation to the processing in the heat exchanger being influenced by corresponding residual contents.

Advantages of the Invention

In principle, while the associated plant is at a standstill, cold gas from a tank or exhaust gas from the stopped plant can flow through a (main) heat exchanger of an air separation plant in order to avoid heating or to maintain the temperature profile formed during steady-state operation (i.e., in particular the usual production operation of a corresponding plant). However, such operation may be complex to realize using conventional methods.

In specific cases, as also proposed, for example, in U.S. Pat. No. 5,233,839 A, in order to avoid cooling the warm end of a corresponding heat exchanger, heat can also be introduced there from the environment via heat bridges. If there is no process unit with significant buffer capacity for cold (e.g., no rectification column system with accumulation of cryogenic liquids) downstream of the heat exchanger, such as in a pure air liquefaction plant, such temperature maintenance can thus reduce the occurrence of excessive thermal stresses when warm process flows are abruptly supplied at the warm end when the heat exchanger is put back into operation. In this case, the warm process flows supplied can be expanded after exiting from the cold end of the heat exchanger and returned as cold flows via the cold end to the warm end, so that the heat exchanger can thus be slowly moved into its normal temperature profile by Joule-Thomson cooling.

If, however, there is a process unit having a considerable buffer capacity for cold (e.g., a rectification column system with accumulation of cryogenic liquids, as in an air separation plant) downstream of the heat exchanger, it is possible, by means of the measures described above, to minimize the occurrence of thermal stresses at this location, but thermal stresses resulting from impermissibly high (temporal and local) temperature gradients can occur at the simultaneously warmed cold end owing to the abrupt starting of through-flow with colder fluid. In this case, the maintenance of the temperature of the warm end even promotes the formation of higher temperature differences at the cold end and thus promotes the occurrence of increased thermal stresses.

The present invention now solves this problem as specified in the corresponding independent claims. For this purpose, it proposes a method for operating an air separation plant having a distillation column system designed for cryogenic rectification, a heat exchanger and an adsorber. The heat exchanger is in particular the main heat exchanger of the air separation plant.

The present invention relates in particular to such measures which avoid excessive thermal loading of the cold end of the heat exchanger. However, such measures can be combined at any time with further measures aimed at reducing thermal stresses at the warm end of the heat exchanger.

In addition to corresponding measures for controlling the temperature of the warm end of a corresponding heat exchanger, the present invention can also be combined at any time with further measures for controlling the temperature of the cold end of the heat exchanger.

The present invention proposes carrying out the method in a first operating mode and in a second operating mode, wherein the first operating mode is carried out in a first time period and the second operating mode is carried out in a second time period, and the second time period is after the first time period. Within the scope of the present invention, the second time period and the first time period do not overlap one another and are carried out multiple times alternately. Within the scope of the present invention, the first time period or the first operating mode carried out in this first time period corresponds to the production operation of a corresponding air separation plant, that is to say the operating time period in which liquid and/or gaseous air products are provided. Accordingly, the second operating mode performed in the second operating time period is an operating time period in which corresponding air products are not formed. Corresponding second time periods or second operating modes serve, in particular, for saving energy or costs, for example if no air products are required, incentives from the energy market justify restriction of production, or for performing maintenance work.

As already mentioned, in the second operating mode, flow preferably does not pass through the heat exchanger or passes through it to a significantly lesser extent than in the first operating mode. As already mentioned, the present invention does not exclude that certain quantities of gases are also conducted through a corresponding heat exchanger in the second operating mode, for example in order to maintain it at or bring it to temperature in support of the measures proposed according to the invention. However, the quantity of fluids conducted through the heat exchanger in the second operating mode is always significantly below the quantities of fluids conducted through the heat exchanger in a regular first operating mode. Within the scope of the present invention, the amount of the fluids conducted through the heat exchanger in the second operating mode is, for example, not more than 20%, 10%, 5%, or 1% in total relative to the amount of fluid conducted through the heat exchanger in the first operating mode.

Within the scope of the present invention, the first operating mode and the second operating mode are carried out multiple times alternately with respect to one another, i.e. the first operating mode is always followed by the second operating mode, and the second operating mode is then followed by the first operating mode again, and so on. However, this does not preclude, in particular, that further operating modes can be provided between the first and second operating modes or between the second and first operating modes, in particular the third operating mode provided according to the invention between the second and first operating modes. Within the scope of the present invention, in particular the following sequence results: first operating mode—second operating mode—third operating mode—first operating mode, etc.

Within the scope of the present invention, in the first operating mode compressed air is at least partially freed of water and carbon dioxide in the adsorber and at least part of said compressed air is cooled in the heat exchanger. Furthermore, in the first operating mode an air product is removed from the distillation column system and at least part of said air product is heated in the heat exchanger.

By operating the air separation plant, a first end of the heat exchanger, at which the compressed air to be cooled is fed in and the heated air product is removed, is brought to a first temperature level. A second end of the heat exchanger, at which the air product to be heated is fed in and the cooled compressed air is removed, is brought to a second temperature level below the first temperature level. The first temperature level in this case corresponds in particular to ambient temperature and comprises, for example, temperatures of 0 to 50° C. The second temperature level corresponds in particular to the removal temperature of the air product from the distillation column system and is preferably at significantly cryogenic temperatures, in particular at −50° C. to −200° C., for example at −100° C. to −200° C. or at −150° C. to −200° C.

If it is stated here that the specifically discussed compressed air or a specifically discussed air product is correspondingly cooled or heated, it is of course not ruled out that further fluid flows can also be cooled or heated. Corresponding further fluid flows can have an identical or different composition. For example, compressed air can be provided in the form of a total flow from which multiple subflows can be formed and cooled to identical or different temperatures. Furthermore, within the scope of the present invention, it is also optionally possible for multiple fluid flows to be removed from the distillation column system or a corresponding storage system and heated together or separately from one another in the heat exchanger.

Corresponding fluid flows can also be divided, for example in the heat exchanger, into two or more subflows, which are removed from the heat exchanger at the same or different temperatures. Of course, it is also possible to add a further fluid flow in the heat exchanger and to further heat a combined flow formed in this way in the heat exchanger. In any case, however, compressed air and an air product (alone or together with further flows as explained above) are cooled or heated in the heat exchanger.

In the second operating mode, within the scope of the present invention, the cooling of the compressed air and the heating of the air product in the heat exchanger are partially or completely suspended. For example, it is possible for no fluid to be conducted through the heat exchanger instead of these fluids, which are conducted through the heat exchanger and cooled or heated in the heat exchanger in the first operating mode. The heat exchanger passages of the heat exchanger used for cooling and heating in the first operating mode thus remain without flow in this case. However, instead of the compressed air or air product which is conducted through the heat exchanger and cooled or heated in the first operating mode, it is also possible to conduct other fluid flows through the heat exchanger, in particular in a significantly smaller amount. Within the scope of the present invention, however, during the second operating mode the effect arises that the warm end of the heat exchanger cools down and/or the cold end of the heat exchanger is heated, wherein, as mentioned, the invention relates in particular to measures which prevent the occurrence of excessive temperature stresses at the cold end of the heat exchanger.

One aspect of the present invention is therefore that in the second operating mode the second end of the heat exchanger, to which the air product to be heated is fed and from which the cooled compressed air is removed in the first operating mode, is allowed to heat up from the second temperature level to a higher temperature level. This is in particular a heating to a third temperature level, as will also be explained below with reference to the third operating mode. The third temperature level can lie at an average temperature between the first and second temperature levels or deviates in particular by no more than 10 K therefrom. As mentioned, the first end of the heat exchanger, to which the compressed air to be cooled is fed and from which the heated air product is removed in the first operating mode, can in particular also cool down, but the present invention does not primarily relate to measures which relate to a temperature control of the heat exchanger at this first end, the "warm end".

According to the invention, provision is now made for a third operating mode to be carried out in a third time period between the second time period and the first time period or a further first time period which follows a previous second time period during multiply alternating operation. This third operating mode serves, in particular, for controlling the temperature of the second, i.e. cold end of the heat exchanger, which, during the second operating mode, has been heated to the third temperature level in the manner explained, because a corresponding heating has been allowed, for example by a lack of temperature control in this second operating mode. According to the invention, the third operating mode is carried out in particular to bring the second, i.e. cold end of the heat exchanger back to the second temperature level or close to the second temperature level from a correspondingly increased third temperature level, in order to subsequently be able to operate a corresponding plant again normally in the first operating mode, i.e. to be able to feed in cryogenic fluid in the form of the air product and possibly other flows at the cold end of the heat exchanger without causing excessive temperature stresses. Advantageously, the third operating mode is therefore carried out immediately before a subsequent new first time period.

According to the invention, in the third operating mode, in principle in the same way as in the first operating mode, compressed air is at least partially freed of water and carbon dioxide in the adsorber, and at least part of said compressed air is cooled in the heat exchanger. In the third operating mode, the air product is likewise removed from the distillation column system, and at least part of said air product is heated in the heat exchanger. The amounts used here can be the same as or different than in the first operating mode. According to the invention, an adjustable portion of the compressed air cooled in the heat exchanger or an adjustable amount of additional compressed air, which was at least partially freed of water and carbon dioxide in the adsorber but not cooled in the heat exchanger, is fed to the air product before the air product is heated in the heat exchanger.

Since, owing to the gradual start-up the cooling power of the heat exchanger, in particular owing to the heat input from the environment and the temperature equalization between the first and the second ends, the compressed air in the third operating mode is initially not cooled as much as when power is later completely restored, the temperature to which the compressed air is cooled or can be cooled is significantly higher in the third operating mode than in the first operating mode. Therefore, the cooled compressed air in the third operating mode can be used for temperature control by feeding it in an adjustable amount to the air product, which is present at significantly lower temperatures. The not yet cooled compressed air naturally also has a significantly higher temperature and can therefore likewise be used in a corresponding manner.

The use of the measures according to the invention means, as mentioned several times, that a cold end of a heat exchanger is not directly charged with cryogenic fluids, but can be gradually cooled, after a longer standstill phase in which this cold end has been heated. As mentioned, the third operating mode is advantageously carried out until the first end is again at the first temperature level or is sufficiently close to the first temperature level and until the second end is again at the second temperature level or is sufficiently close to the second temperature level. "Sufficiently close" can apply in particular in the case of a temperature difference which is below a predetermined threshold of, for example, 30, 20, 10 or 5 K, or can be taken from applicable guidelines.

Within the scope of the present invention, the temperature level of a fluid flow which is formed from the air product and the portion of the compressed air or the additional compressed air in the third operating mode can be reduced successively. Within the scope of the present invention, a corresponding successive reduction can comprise a gradual and/or stepwise reduction. A gradient of the reduction can be adapted in particular in terms of its steepness to the present temperatures or material characteristic variables (for example thermal compatibilities or stress resistances). A gradual or stepwise reduction does not need to take place continuously over the entire third time period, but rather reduction time periods with different gradients can also be used.

The successive reduction can comprise an adjustment of an amount of the compressed air fed in. The adjustment of the amount advantageously comprises the use of an open- and/or closed-loop control device, as already explained above.

The previously discussed air product can in particular be so-called impure nitrogen, i.e. a nitrogen-containing fluid with an oxygen content of, for example, up to 21% (typically up to 10%), which is removed from a low-pressure column of the distillation column system, that is to say a distillation column which is operated at a pressure level of 1 to 2 bar (abs.), in particular 1.1 to 1.3 bar (abs.).

The present invention also extends to an air separation plant which is designed as specified in the corresponding independent claim. Reference is expressly made to the above statements with regard to features and advantages of a corresponding air separation plant which is in particular designed to carry out a method as has been explained above.

The invention is described in more detail hereafter with reference to the accompanying drawings, which show an embodiment of the invention and corresponding heat exchange diagrams.

In the figures, elements which are identical or correspond to one another in function or meaning are indicated by identical reference signs and for the sake of clarity are not explained repeatedly.

DETAILED DESCRIPTION OF THE DRAWINGS

Figure 1:
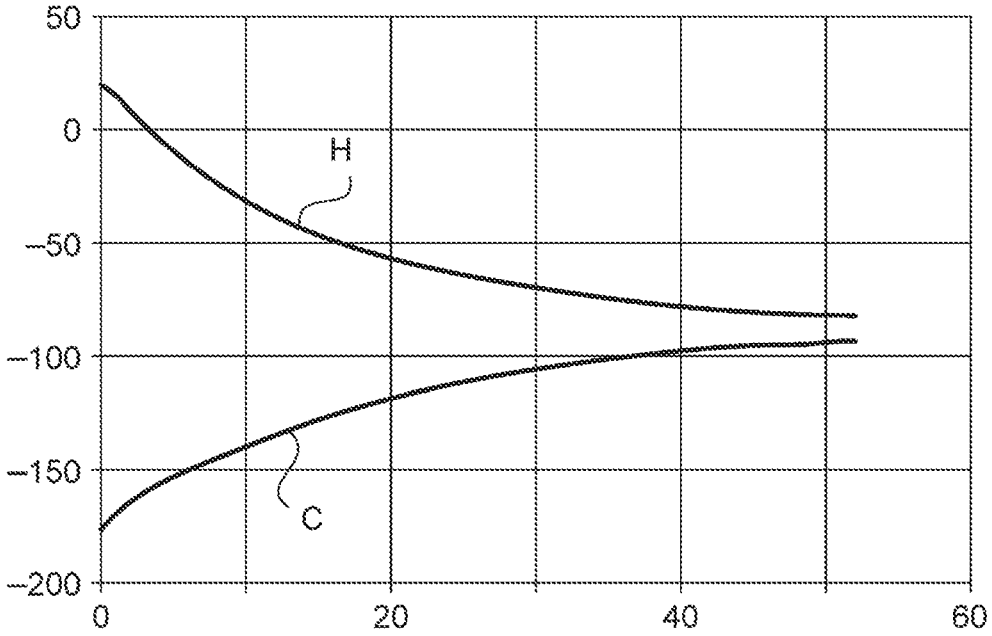
FIG. 1 illustrates temperature profiles in a heat exchanger after it has been taken out of operation without the use of measures according to an embodiment of the present invention.

FIG. 1 illustrates temperature profiles in a heat exchanger after it has been taken out of operation without the use of measures according to advantageous embodiments of the present invention, in the form of a temperature graph.

In the diagram shown in FIG. 1, a temperature at the warm end of a corresponding heat exchanger, denoted by H, and a temperature at the cold end, denoted by C, are each shown in ° C. on the ordinate over a time in hours on the abscissa.

As can be seen from FIG. 1, at the beginning of the shutdown, the temperature H at the warm end of the heat exchanger, which still corresponds to the temperature in a regular operation of the heat exchanger, is approximately +20° C., and the temperature C at the cold end is approximately −175° C. These temperatures converge over time. The high thermal conductivity of the materials installed in the heat exchanger is responsible for this. In other words, heat flows from the warm end toward the cold end here. Together with the heat input from the environment, an average temperature of approximately −90° C. results. The significant temperature increase at the cold end occurs largely due to the internal temperature equalization in the heat exchanger and only to a smaller extent due to external heat input.

As mentioned several times, in the case shown, severe thermal stresses may occur if the warm end of the heat exchanger is again subjected to a warm fluid of approximately 20° C. in the example shown after some time of regeneration without further measures. However, thermal stresses may also correspondingly occur if a plant downstream of the heat exchanger immediately delivers cryogenic fluids again, for example cryogenic gases from a rectification column system of an air separation plant. The present invention addresses in particular the latter problem.

Figure 2:
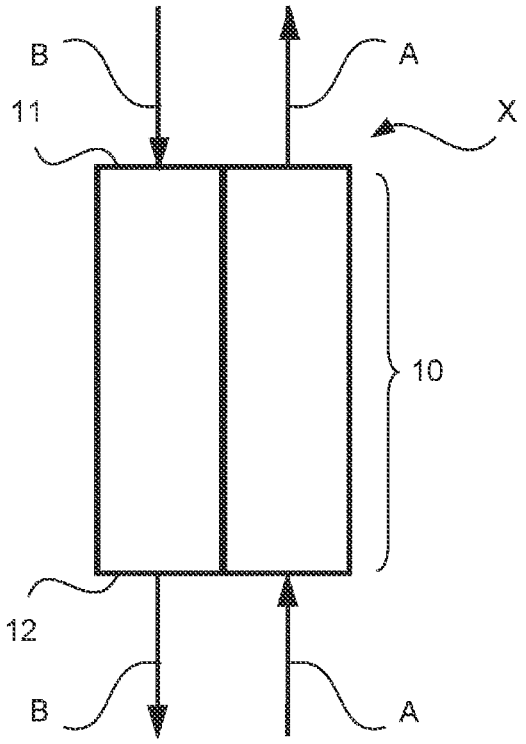
FIG. 2 illustrates an arrangement with a heat exchanger.

FIG. 2 illustrates an arrangement with a heat exchanger 1 in which the measures proposed according to the invention are not realized. The heat exchanger 1 has a heat exchange region 10 to which fluids are supplied and from which fluids are removed at a first, i.e. warm end 11 and to which fluids are likewise supplied and from which fluids are removed at a second, i.e. cold end 12. In the example shown, a fluid flow A, in an air separation plant an air product from a distillation column system, is fed to the heat exchanger 1 at the cold end 12, is heated in the heat exchange region 10 of the heat exchanger 1, and is removed again at the warm end 11. The first fluid flow A heats up accordingly. In the illustration according to FIG. 2, a second fluid flow B (in an air separation plant compressed air from an adsorber) is also fed to the heat exchanger 1 at the warm end 11 and removed at the cold end 12.

In this way, different temperature levels, here referred to as "first" and "second" temperature level, result at the warm end 11 and the cold end 12. If the supply of the fluid flows A and B is prevented, the temperatures therefore change correspondingly and in particular the temperature at the cold end 12 increases correspondingly to a "third" temperature level.

As mentioned several times, when the first fluid flow A is to be fed back to the heat exchanger 1 at the second temperature level, but the cold end 12 of the heat exchanger 1 has been heated to a temperature level significantly above the first temperature level, temperature stresses here would therefore possibly lead to damage to the heat exchanger 1 over a relatively long time.

Figure 3:
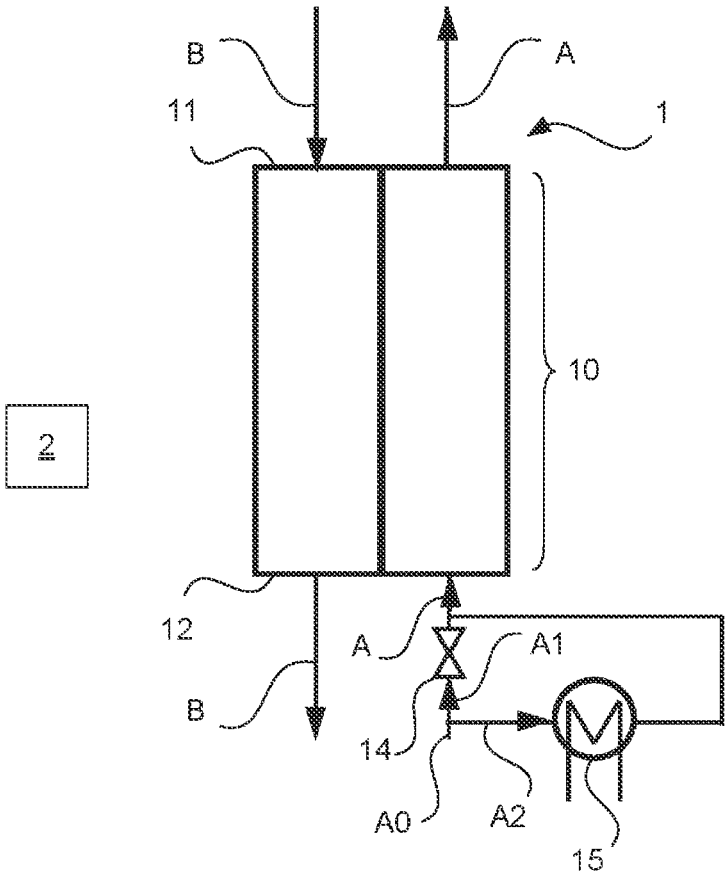
FIG. 3 illustrates a further arrangement with a heat exchanger.

FIG. 3 therefore illustrates an arrangement with a heat exchanger 1 wherein a portion of an air product is heated before being introduced into heat exchanger 1. For the designation of the respective elements of FIG. 3, reference is made here to the explanations relating to FIG. 2. Here too, a fluid flow A which is formed from an air product can be fed to the heat exchanger 1.

However, this fluid flow A can be formed as needed using a first output flow A1 and a second output flow A2. In the embodiment according to FIG. 3, the first output flow A1 and the second output flow A2 are branched off from a base flow A0, or the base flow A0 is divided into the output flows A1 and A2. The output flow A1 is used to form the first fluid flow A by restriction by means of a control element 14, which can be actuated in particular by a suitable open- and/or closed-loop control device 2, for example a valve under open- or closed-loop control.

By contrast, the output flow A2 is guided through and heated in a heater 15. After the heating, the subflow A2 is combined with the subflow A1. An adjustable mixing temperature results. This mixing temperature can be adjusted by adjusting the respective portions of the first and second output flows A1, A2 or an amount of the energy introduced above the heater 15. As mentioned, the temperature level is in particular reduced gradually.

Figure 4:
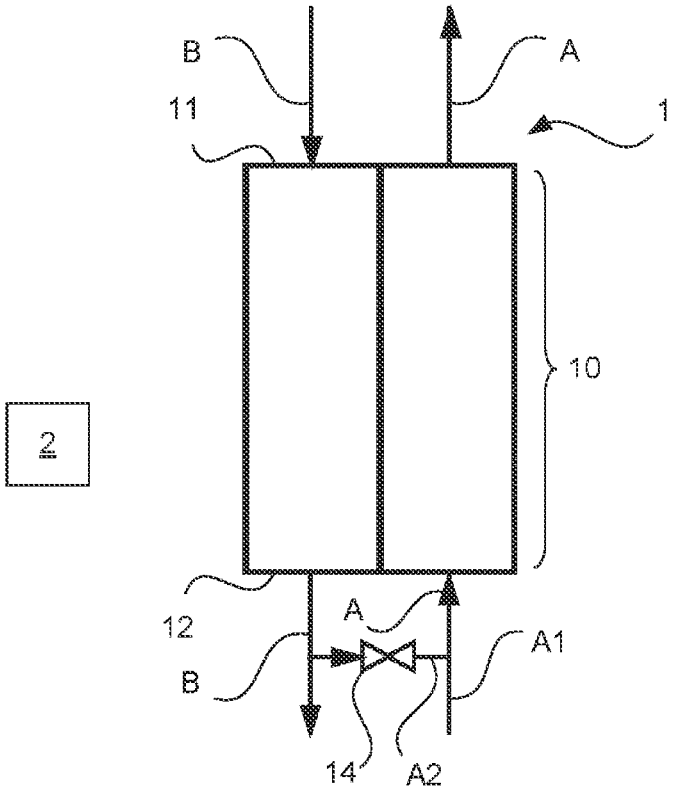
FIG. 4 illustrates an arrangement according to an embodiment of the invention.

FIG. 4 illustrates an arrangement with a heat exchanger 1 according to an embodiment of the present invention. In a departure from the arrangement according to FIG. 3, in this case a control element 14 is arranged in such a way that, if necessary, a part of the cooled compressed air in the form of the fluid flow B is fed as a second output flow A2 to an output flow A1 and can thus be used to form the fluid flow A which otherwise comprises an air product. Here too, a mixing temperature can be obtained in the manner explained by adjustment or regulation according to a control unit 2.

Figure 5:
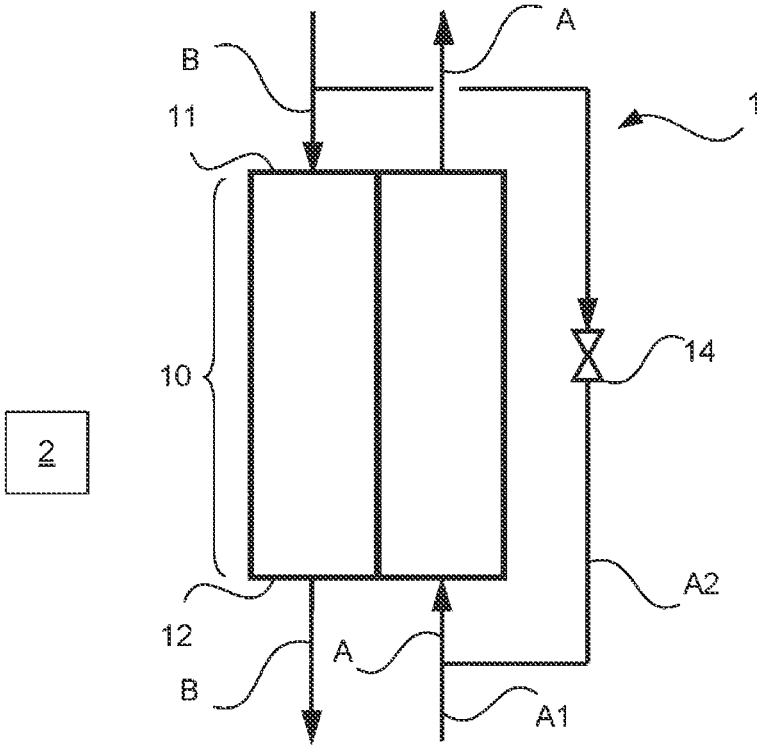
FIG. 5 illustrates an arrangement according to an embodiment of the invention.

In the embodiment according to FIG. 5, in which an arrangement with a heat exchanger 1 according to an embodiment of the present invention is also illustrated, a corresponding control element 14 is provided so that the fluid flow A can be formed from uncooled compressed air, which otherwise is used to form substance flow B, so that here too a corresponding mixing temperature can be obtained.

Figure 6:
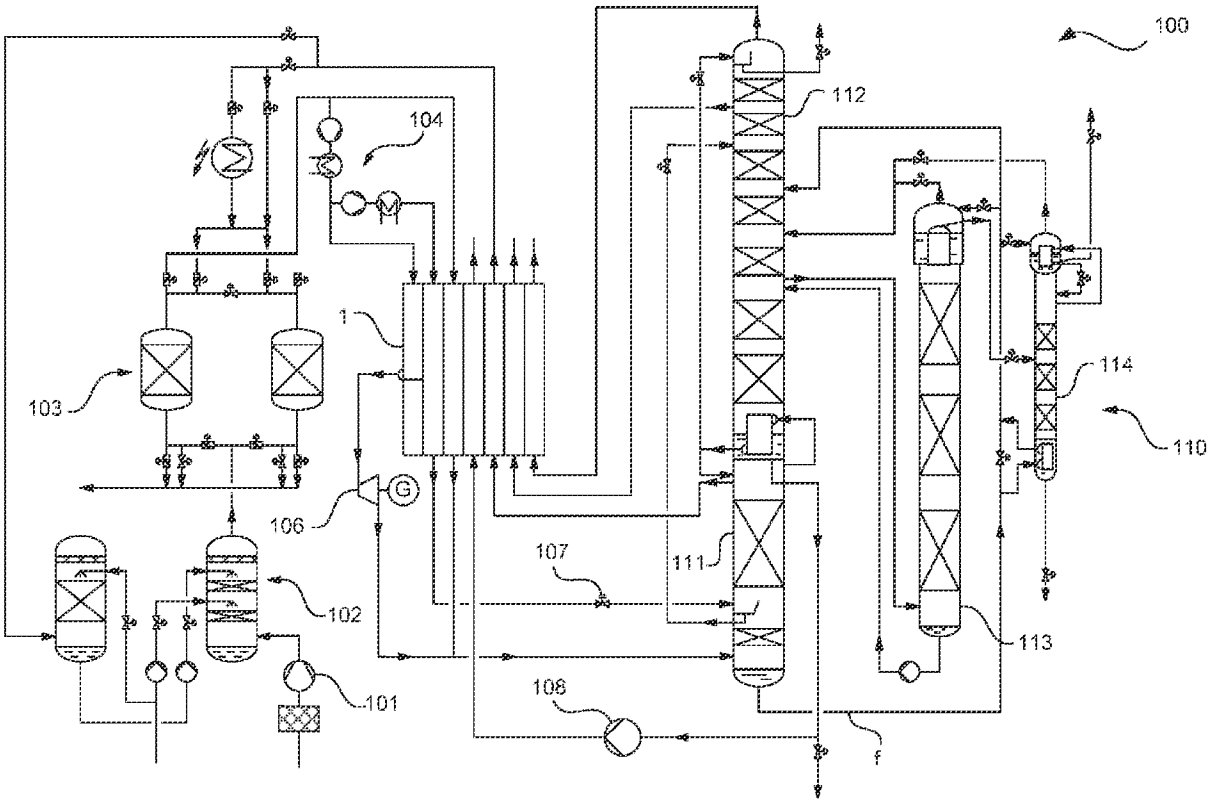
FIG. 6 illustrates an air separation plant which can be operated according to an embodiment of the invention.

FIG. 6 illustrates an air separation plant having a heat exchanger, which can be operated using a method according to an advantageous embodiment of the present invention.

As mentioned, air separation plants of the type shown are described multiple times elsewhere, for example in H.-W. Häring (ed.), Industrial Gases Processing, Wiley-VCH, 2006, in particular section 2.2.5, "Cryogenic Rectification." For detailed explanations regarding structure and operating principle, reference is therefore made to corresponding technical literature. An air separation plant for use of the present invention can be designed in a wide variety of ways. The use of the present invention is not limited to the embodiment according to FIG. 6.

The air separation plant shown in FIG. 6 is designated as a whole with 100. It has, inter alia, a main air compressor 101, a pre-cooling device 102, an adsorber 103, a secondary compressor arrangement 104, a main heat exchanger, denoted by 1 like the heat exchanger of FIGS. 2 to 5, an expansion turbine 106, a throttle device 107, a pump 108, and a distillation column system 110. In the example shown, the distillation column system 110 comprises a traditional double-column arrangement consisting of a high-pressure column 111 and a low-pressure column 112 as well as a crude argon column 113 and a pure argon column 114.

In the air separation plant 100, an input air flow is sucked in and compressed by means of the main air compressor 101 via a filter (not labeled). The compressed input air flow is supplied to the pre-cooling device 102 operated with cooling water. The pre-cooled input air flow is cleaned in the adsorber 103. In the adsorber 103, the pre-cooled input air flow is largely freed of water and carbon dioxide.

Downstream of the adsorber 103, the input air flow is divided into two subflows. One of the subflows is completely cooled in the main heat exchanger 1 at the pressure level of the input air flow. The other subflow is recompressed in the secondary compressor arrangement 104 and likewise cooled in the main heat exchanger 1, but only to an intermediate temperature. After cooling to the intermediate temperature, this so-called turbine flow is expanded by means of the expansion turbine 106 to the pressure level of the completely cooled subflow, combined with it, and fed into the high-pressure column 111.

An oxygen-enriched liquid bottom fraction and a nitrogen-enriched gaseous top fraction are formed in the high-pressure column 111. The oxygen-enriched liquid bottom fraction f is removed from the high-pressure column 111, partially used as heating medium in a bottom evaporator of the pure argon column 114, and fed in each case in defined proportions into a top condenser of the pure argon column 114, a top condenser of the crude argon column 113, and the low-pressure column 112. Fluid evaporating in the evaporation chambers of the top condensers of the crude argon column 113 and the pure argon column 114 is also transferred into the low-pressure column 112.

The gaseous nitrogen-rich top product is removed from the top of the high-pressure column 111, liquefied in a main condenser which produces a heat-exchanging connection between the high-pressure column 111 and the low-pressure column 112, and, in proportions, applied as a reflux to the high-pressure column 111 and expanded into the low-pressure column 112.

An oxygen-rich liquid bottom fraction and a nitrogen-rich gaseous top fraction are formed in the low-pressure column 112. The former is partially brought to pressure in liquid form in the pump 108, heated in the main heat exchanger 105, and provided as a product. A liquid nitrogen-rich flow is withdrawn from a liquid retaining device at the top of the low-pressure column 112 and discharged from the air separation plant 100 as a liquid nitrogen product. A gaseous nitrogen-rich flow withdrawn from the top of the low-pressure column 112 is conducted through the main heat exchanger 105 and provided as a nitrogen product at the pressure of the low-pressure column 112. Furthermore, a flow is removed from an upper region of the low-pressure column 112 and, after heating in the main heat exchanger 1, is used as so-called impure nitrogen in the pre-cooling device 102 or, after heating by means of an electric heater, is used in the cleaning system 103.

It is this impure nitrogen, in particular, to which the compressed air can be fed in the third operating mode in the explained embodiments of the invention.

Figure 7:
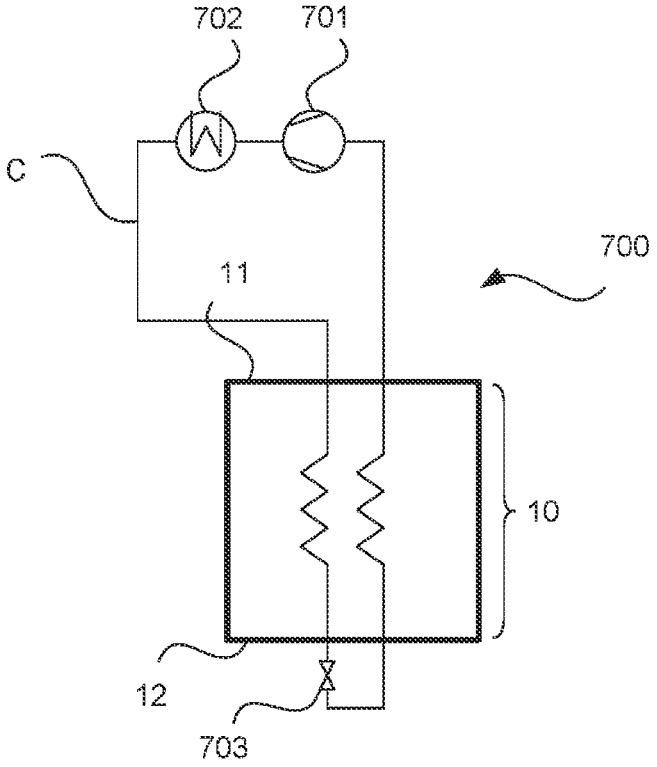
FIG. 7 illustrates a further arrangement with a heat exchanger.

FIG. 7 shows a further non-inventive arrangement with a heat exchanger 1 which is denoted as a whole by 700. For temperature control, a circulation flow C is used here, which is compressed on the warm side of the heat exchanger by means of a compressor 701, pre-cooled in a cooler 702, fed to the heat exchanger 1 at the warm end 11, removed from the heat exchanger 1 at the cold end 12, expanded by means of a valve 703, fed back to the heat exchanger 1 at the cold end 12, removed again from the heat exchanger 1 at the warm end 11, and fed again to the compressor 701. The expansion at the valve 703 results in gradual cooling.

The invention claimed is:

1. A method for operating an air separation plant which comprises a distillation column system, a heat exchanger, and an adsorber, wherein the process comprises:

in a first time period, a first operating mode is carried out and, in a second time period following the first time period, a second operating mode is carried out, the first and second time periods being carried out multiple times alternately, in the first operating mode, compressed air is at least partially freed of water and carbon dioxide in the adsorber and at least part of said compressed air is cooled in the heat exchanger, in the first operating mode, an air product is removed from the distillation column system and at least part of said air product is heated in the heat exchanger, in the first operating mode, a first end of the heat exchanger is brought to a first temperature level and a second end of the heat exchanger is brought to a second temperature level below the first temperature level, in the second operating mode, the cooling of the compressed air and the heating of the air product in the heat exchanger are partially or completely suspended, and in the second operating mode, the temperature of the second end of the heat exchanger increases from the second temperature level to a third temperature level above the second temperature level, wherein in a third time period between the second time period and the first time period, a third operating mode is carried out, in the third operating mode, compressed air is at least partially freed of water and carbon dioxide in the adsorber and at least part of said compressed air is cooled in the heat exchanger, in the third operating mode, the air product is removed from the distillation column system and at least part of said air product is heated in the heat exchanger, and in the third operating mode, an adjustable portion of the compressed air cooled in the heat exchanger or an adjustable amount of additional compressed air, which is at least partially freed of water and carbon dioxide in the adsorber but is not cooled in the heat exchanger, is fed to the air product to form a combined stream before the air product is heated in the heat exchanger.

2. The method according to claim 1, wherein, during the third operating mode, a temperature level of the combined steam is reduced successively.

3. The method according to claim 2, wherein the successive reduction of the temperature level of the combined stream comprises successively decreasing the portion of the compressed air or the amount of the additional compressed air.

4. The method according to claim 3, wherein the adjustment of the portion of the compressed air or the amount of the additional compressed air comprises using an open- and/or closed-loop control device.

5. The method according to claim 1, wherein, in the second operating mode, the temperature of the first end of the heat exchanger decreases from the first temperature level, and the third operating mode is carried out until the first end of the heat exchanger is again at or close to the first temperature level such that a temperature difference is below a predetermined threshold.

6. The method according to claim 5, wherein the distillation column system comprises a low-pressure column and in which a nitrogen-rich and oxygen-containing gas mixture removed from the low-pressure column is used as the air product.

7. The method according to claim 1, wherein the amount of the fluids conducted through the heat exchanger in the second operating mode is not more than 20% in total relative to the amount of fluid conducted through the heat exchanger in the first operating mode.

8. The method according to claim 1, wherein the first temperature level is within the range of 0 to 50° C., and the second temperature level is with the range of −50° C. to −200° C.

9. The method according to claim 1, wherein the third temperature level deviates from the average temperature between the first and second temperature levels by no more than 10 K.

10. The method according to claim 1, wherein the third operating mode is carried out until the second end of the heat exchanger is again at or close to the second temperature level such that a temperature difference is below a predetermined threshold.

11. The method according to claim 5, wherein the temperature difference is below 30K.

12. The method according to claim 10, wherein the temperature difference is below 30K.

13. The method according to claim 1, wherein the distillation column system comprises a high pressure column and a low pressure column, and the air product is an impure nitrogen-containing fluid removed from the low-pressure column.

14. An air separation plant comprising:

a distillation column system, a heat exchanger, and an adsorber, the air separation plant being designed to carry out a first operating mode in a first time period and a second operating mode in a second time period which is after the first time period, in the first operating mode, to free compressed air at least partially of water and carbon dioxide in the adsorber and to cool at least part of said compressed air in the heat exchanger, in the first operating mode, to remove an air product from the distillation column system and to heat at least part of said air product in the heat exchanger, in the first operating mode, to bring a first end of the heat exchanger to a first temperature level and a second end of the heat exchanger to a second temperature level below the first temperature level, in the second operating mode, to partially or completely suspend the cooling of the compressed air and the heating of the air product in the heat exchanger, and in the second operating mode, to increase the temperature of the second end of the heat exchanger from the second temperature level to a third temperature level above the second temperature level, wherein the plant is designed in a third time period between the second time period and the first time period, to carry out a third operating mode, in the third operating mode, to free compressed air at least partially of water and carbon dioxide in the adsorber and to cool at least part of said compressed air in the heat exchanger, in the third operating mode, to remove the air product from the distillation column system, and to heat at least part of said air product in the heat exchanger, and in the third operating mode, to feed an adjustable portion of the compressed air cooled in the heat exchanger or an adjustable amount of additional compressed air which is at least partially freed of water and carbon dioxide in the adsorber, but is not cooled in the heat exchanger, to the air product before the air product is heated in the heat exchanger.

* * * * *